US005725458A

United States Patent [19]

Newman et al.

[11] Patent Number: 5,725,458

[45] Date of Patent: Mar. 10, 1998

[54] THREE BAG WORKOUT APPARATUS

[76] Inventors: Jerry Newman, 3837 Thompson Creek Ct., San Jose, Calif. 95135; John N. Newman, Jr., 2466 Wooding Ct., San Jose, Calif. 95128

[21] Appl. No.: 411,393

[22] Filed: Mar. 28, 1995

Related U.S. Application Data

[63] Continuation of Ser. No. 206,770, Mar. 7, 1994, abandoned.

[51] Int. Cl.[6] ..... A63B 69/34

[52] U.S. Cl. ..... 482/87; 482/83; 482/90

[58] Field of Search ..... 482/83–90

[56] References Cited

U.S. PATENT DOCUMENTS

| | | | |
|---|---|---|---|
| 341,231 | 5/1886 | Goodman | 482/89 |
| 3,598,406 | 8/1971 | Robinson | 482/87 |
| 3,650,530 | 3/1972 | Gantz | 482/90 |
| 4,072,309 | 2/1978 | Wilson | 482/142 |
| 4,403,772 | 9/1983 | Stangle | 482/83 |
| 4,482,150 | 11/1984 | Levine | 482/90 |
| 4,522,394 | 6/1985 | Broussard | 482/90 |
| 4,557,478 | 12/1985 | Levine | 482/90 |
| 4,569,401 | 2/1986 | Luck | 482/83 |
| 4,817,941 | 4/1989 | McCorry | 482/87 |
| 4,911,428 | 3/1990 | Wiece | 482/87 |
| 5,046,724 | 9/1991 | Sotomayer | 482/90 |
| 5,050,866 | 9/1991 | Fucci | 482/90 |

OTHER PUBLICATIONS

"Sportsmobile" desert command car The New York Times Sunday Sep. 16, 1973.

*Primary Examiner*—Jerome Donnelly

*Attorney, Agent, or Firm*—Flehr Hohbach Test Albritton & Herbert LLP

[57] ABSTRACT

A stand base is bolted to a concrete floor. A center pole extends upward from the center of stand base. Four support struts are attached to the stand base and to center pole. At the upper portion of the center pole are several different types of exercising equipment. On side A, near the upper part of center pole, is an extension pole extending outward and supporting a heavy bag. On side B, is an adjustable crank, a back board and a speed bag attached to the back board. On side C of the center pole is a chin up bar. On one end of the chin up bar is a hand grip bar, and threaded into one end of the hand grip bar is an I-bolt. Directly below the I-bolt and located at the base of the stand is another I-bolt. The purpose of the two I-bolts is to attach flexible lines to the upper and lower I-bolts and a punching bag in the center of the two flexible lines.

7 Claims, 9 Drawing Sheets

THREE BAG WORKOUT APPARATUS

This is a continuation of application Ser. No. 08/206,770 filed Mar. 7, 1994 now abandoned.

FIELD OF THE INVENTION

This invention relates to a unit designed to hold and support various types of exercising equipment for home use.

DESCRIPTION OF PRIOR ART

For years people have looked for ways to exercise and train for boxing, karate, and self-defense at home. At present, the support equipment provided for these arts is awkward and ineffective for home use. The reason they are ineffective is the way they have to be supported. For example:

a) A heavy bag can weigh in excess of 150 pounds, and must hang or be supported by a ceiling or wall.

(b) Hanging equipment from a ceiling can be very damaging to a home structure.

(c) Steel beams and rafters in a commercial gym are capable of supporting this equipment, whereas a home is not. Damage to the home structure is the number one problem or obstacle to overcome.

Over the past twenty years, there have been several racks and stacks invented for supporting this type of equipment in the home. See for example: U.S. Pat. Nos. 4,557,478 (1984), 4,482,150 (1982) both to Levine, 4,569,401 to Luck et al. (1984), 4,403,772 to Stangle et al. (1981), 4,817,941 to McCory et al. (1987), 5,050,866 to Fucci et al. (1989), 4,911,428 to Weice et al. (1989), and 5,046,724 to Sotomayer et al. (1989). These are a few examples of racks and stands which are ineffective and do not solve the problem for home gyms.

The equipment described in the above patents suffer from a number of problems.

(a) The user has to stand on a platform while striking the bag in order to hold platform down.

(b) They are awkward, too large, and take up too much space.

(c) They are not suitable for home use because they have to be bolted to a home structure or wall.

(d) Some have movable boxes which make them ineffective.

(e) The interior design and limited use of the equipment makes them ineffective.

(f) Hanging exercise equipment from a ceiling is very damaging to a home.

OBJECTS AND ADVANTAGES

Accordingly, several objects and advantages of the support stand of the present invention are:

(a) to provide and support several different types of exercising equipment, specifically in the art of boxing, karate, and self defense.

(b) to provide and support the equipment in a manner for home use that does not need or use the basic structure of the home, wall or ceiling.

(c) can be installed in the average home garage, taking up minimal space and yet providing support for several basic essential exercises in the arts of boxing, karate, and self defense.

(d) the equipment has been used, tested and improved on by this inventor.

(e) to provide a very unique design, which makes this support stand very effective for home use.

(f) can be used by professionals and amateurs alike, male or female.

A further object and advantage is to have a number of exercising equipments uniquely supported on one stand, thus eliminating the need for different support stands, racks, beams, etc. for each function of equipment.

Still further objects and advantages will become apparent from a consideration of the ensuing descriptions and drawings.

BRIEF DESCRIPTION OF THE DRAWINGS

In the drawings, closely related figures have the same number but different alphabetic suffices.

Reference Numerals in Drawings

Figure 1:
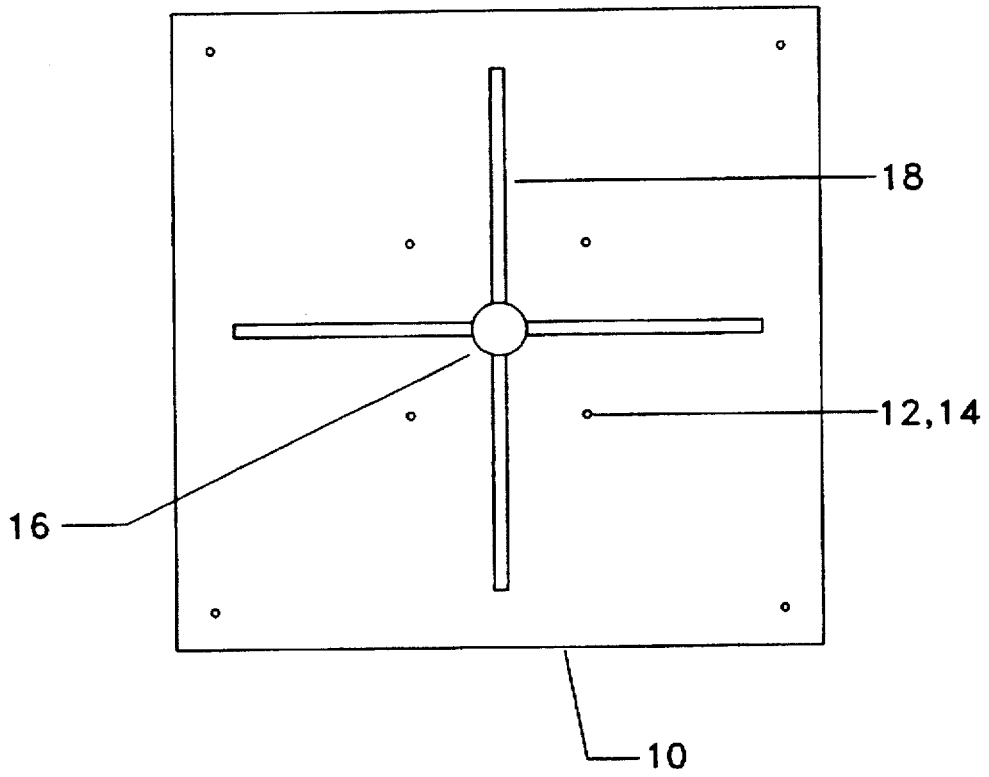
FIG. 1 shows a top view of the lower portion of the support stand, looking down at the support struts, center pole, and blot holes.

10 stand base
12 base bolt holes
14 base bolts
16 center pole
18 (4) support struts
20 extension pole
22 extension support bar
24 I-bolt (for heavy bag)
26 (2) I-bolt holes (for heavy bag)
28 spring
30 chain hook
32 chain
34 heavy bag
36 adjustable crank
38 crank handle
40 crank lock
42 crank threads
**44*a*** upper crank thread support
**44*b*** lower crank thread support
46 back board plate
48 back board
50 speed bag hook
52 speed bag

54 chin up bar
56 hand grip bar
58 support bar (chin up bar)
60*a* upper I-bolt (punching bag)
60*b* lower I-bolt (punching bag)
62*a* upper flexible line
62*b* lower flexible line
64*a* upper flexible line hook
64*b* lower flexible line hook
66 punching bag

DETAILED DESCRIPTION

Figure 2:
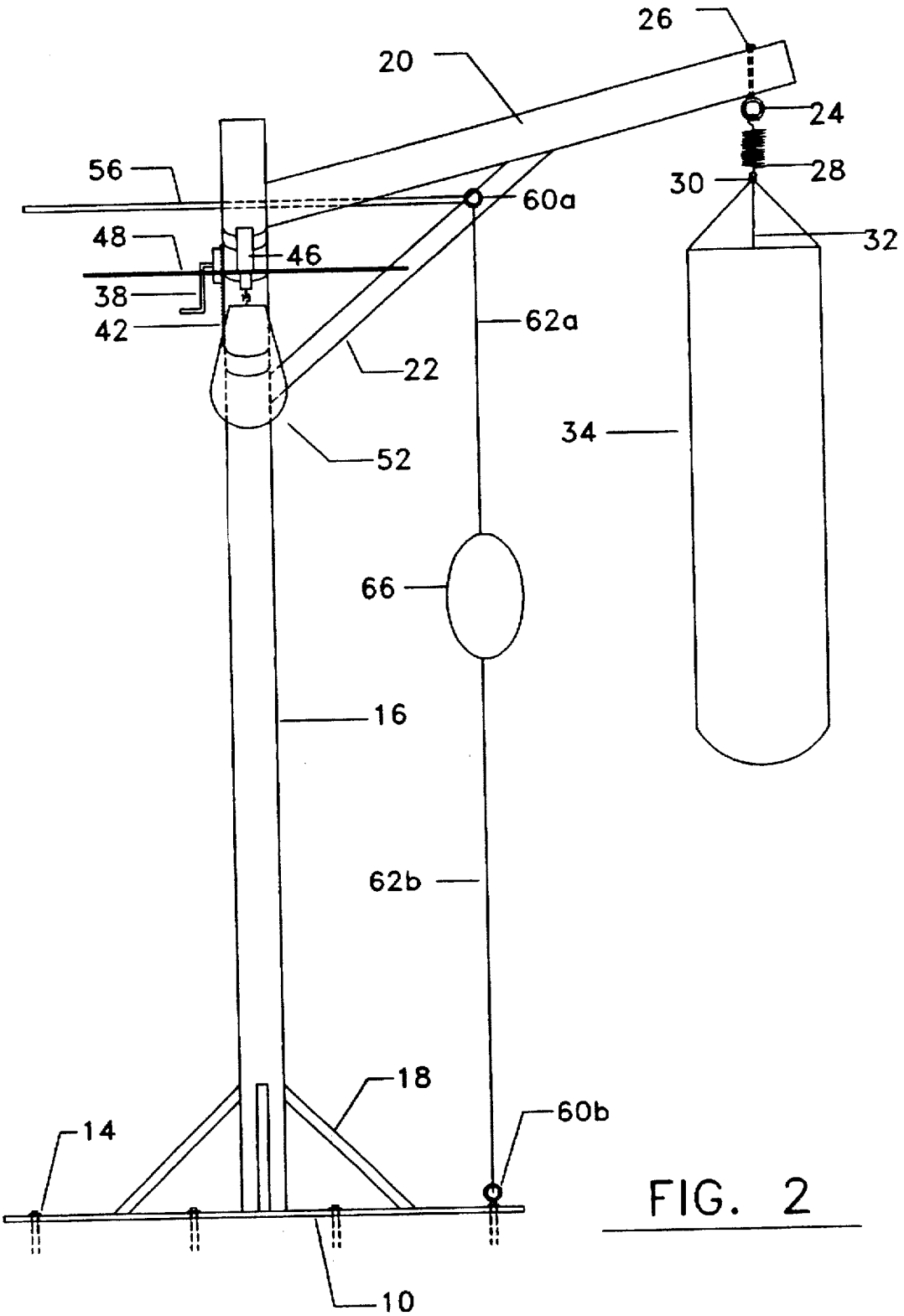
FIG. 2 a view facing the speed bag showing the extension pole, heavy bag, and support struts.
Figure 3:
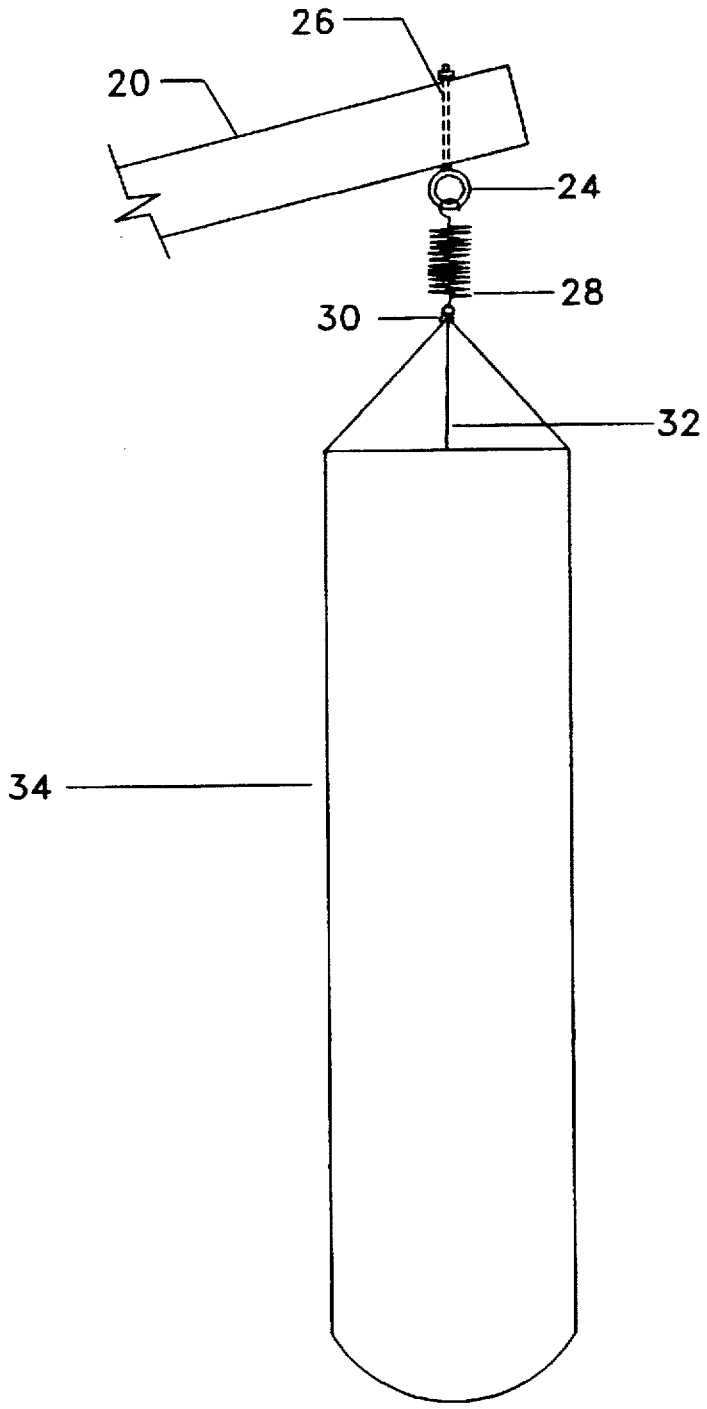
FIG. 3 a fragmented view of the extension pole, showing two I-bolt holes, one I-bolt, a spring, chain hook, chain, and a heavy bag.

The support stand is a unit that holds and supports exercising equipment. FIG. 1 is a top view of a stand base 10, base bolt holes 12, a center pole 16, and four support struts 18. The stand base 10 has a center pole 16, mounted and welded into the center of stand base 10. The lower portion of center pole 16 is given added strength by four support struts 18 which are mounted and welded at the outer end of stand base 10 and extend upward, mounted and welded to center pole 16 (see FIGS. 1–2). The upper portion of center pole 16 has an extension pole 20, mounted and welded, that extends outward. At the outer end of extension pole 20, and extending downward, is an I-bolt 24, a spring 28, a chain hook 30 and a chain 32 connected to a heavy bag 34, as shown in FIGS. 2 and 3. An extension support bar 22 extends from center pole 16 and to the extension pole 20, and is welded at each end (see FIG. 2).

Figure 4:
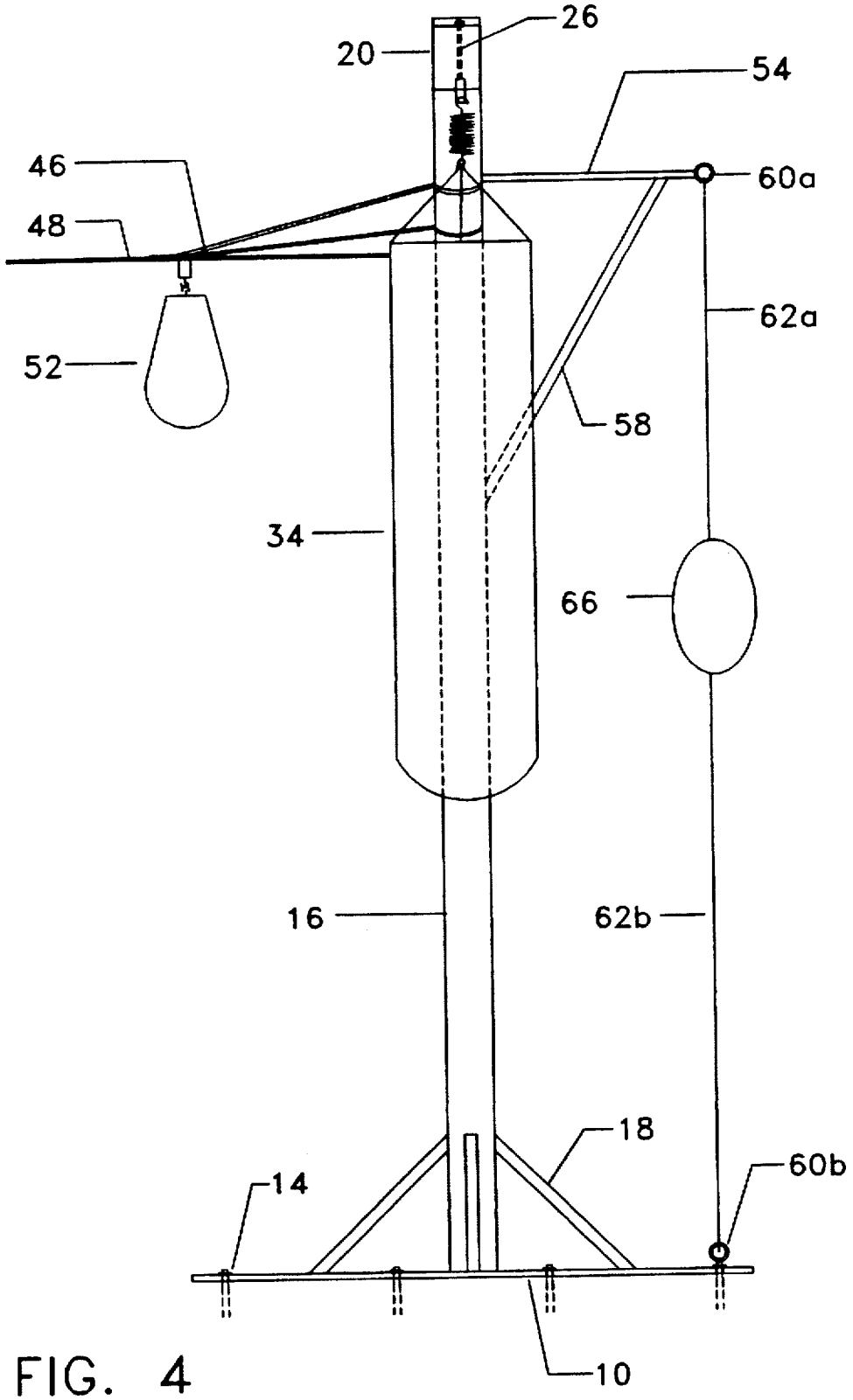
FIG. 4 a view of the support stand, facing the heavy bag, showing the speed bag, backboard, chin up bar, and punching bag.
Figure 8:
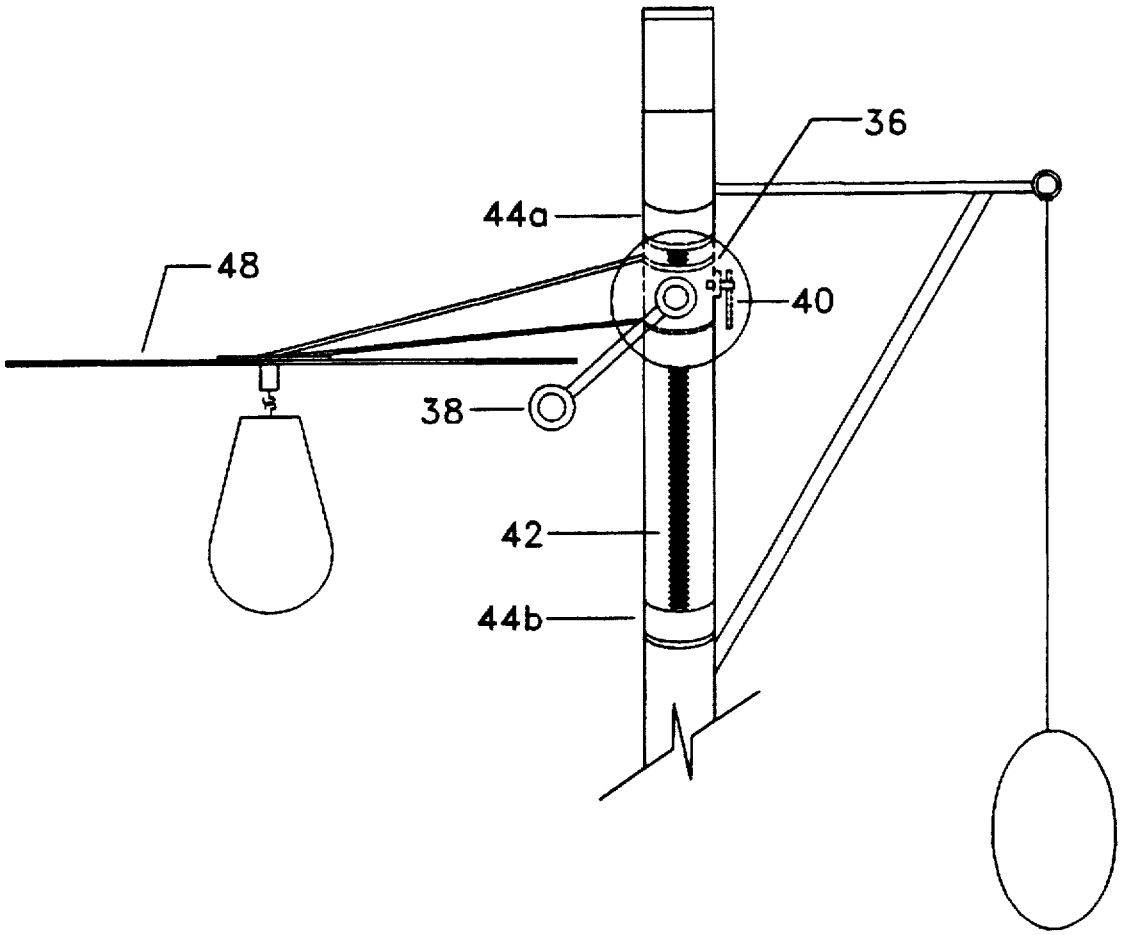
FIG. 8 an enlarged fragmented view of the speed bag back board, adjustable crank, crank handle, crank threads, and crank threads support. The crank is mounted between the extension pole and support bar for the heavy bag. The adjustable crank is a conventional crank.

There are three sides used on the center pole 16. They are sides A, B and C. Side A, in FIGS. 2 and 4, shows the extension pole 20 and heavy bag 34. Side B, shown in FIGS. 2,4 and 8, has an adjustable crank 36 for a speed bag 52. The adjustable crank 36 is fitted around the center pole 16. A back board plate 46 and a back board 48 are mounted to the adjustable crank 36. The adjustable crank 36 has a crank handle 38 for up and down adjustments, and a crank lock 40 to hold and keep it in place when set at a desired position. The crank is a conventional design.

Figure 5:
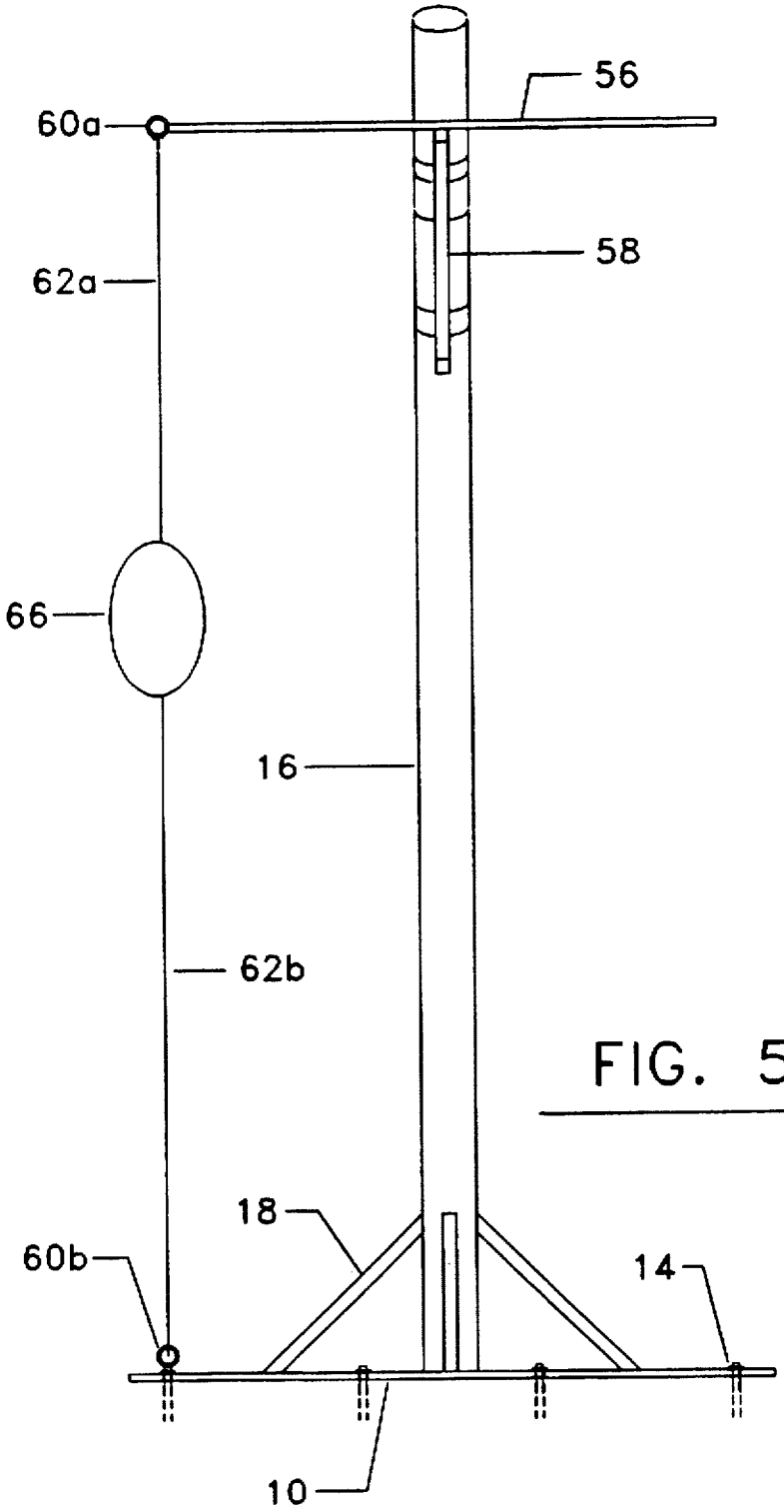
FIG. 5 a view of the support stand showing the chin up bar, punching bag, and I-bolts.
Figure 6:
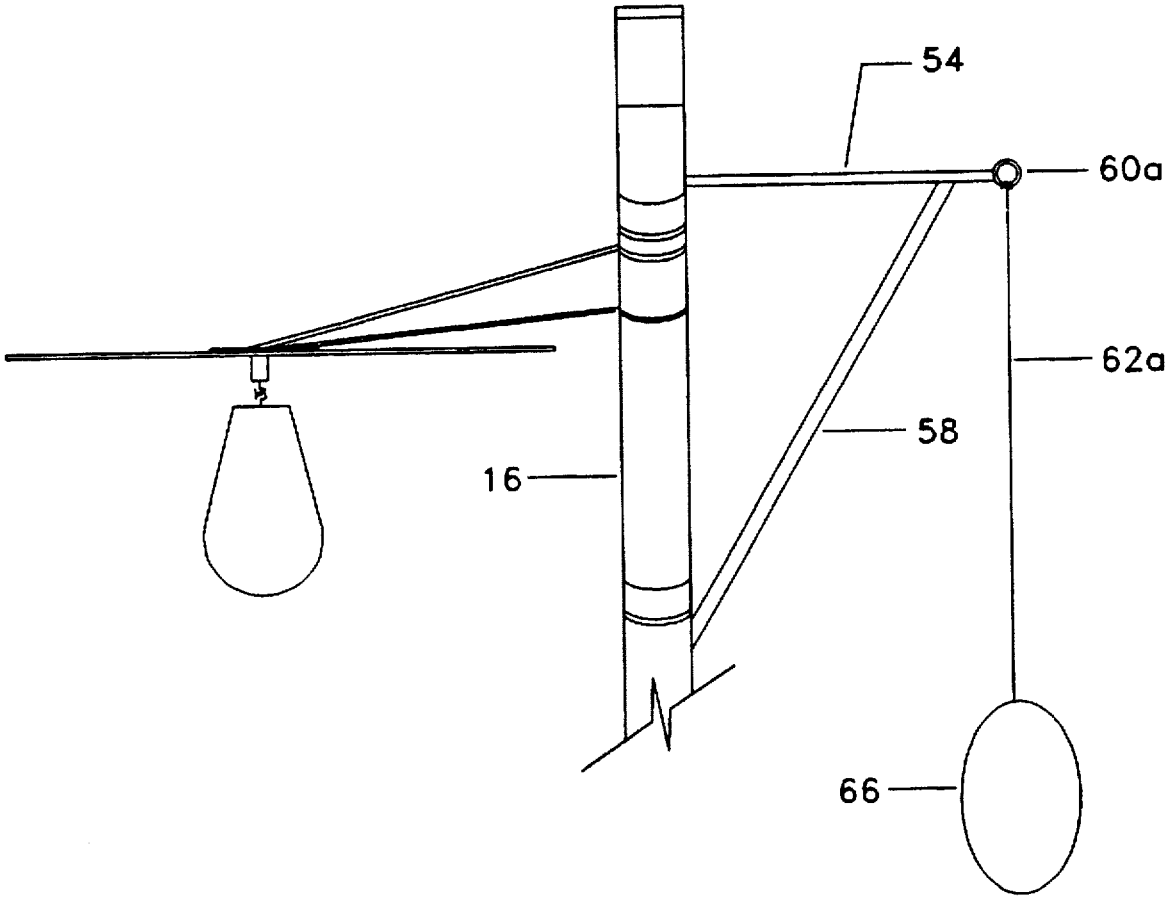
FIG. 6 a fragmented side view of the chin up bar, support bar, and center pole.
Figure 7:
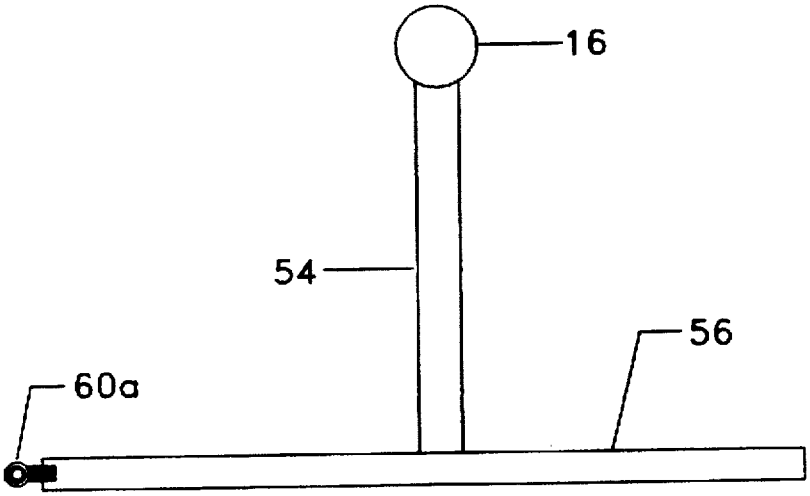
FIG. 7 a fragmented top view, showing the chin up bar, hand grip bar, I-bolt and threads.

Side C, shown in FIGS. 4,5,6 and 7, shows a chin up bar 54 and a support bar 58 welded to center pole 16. A hand grip bar 56 is welded to chin up bar 54. At one end of the hand grip bar 56 is an upper I-bolt 60 that is threaded into the hand grip bar 56, as shown in FIG. 7 top view. FIG. 5 shows how the upper I-bolt 60*a* and lower I-bolt 60*b* are used to hold punching bag 66. The punching bag has an upper and lower flexible line 62*a* and 62*b* that hook to an upper and lower I-bolt 60*a* and 60*b*.

Figure 9:
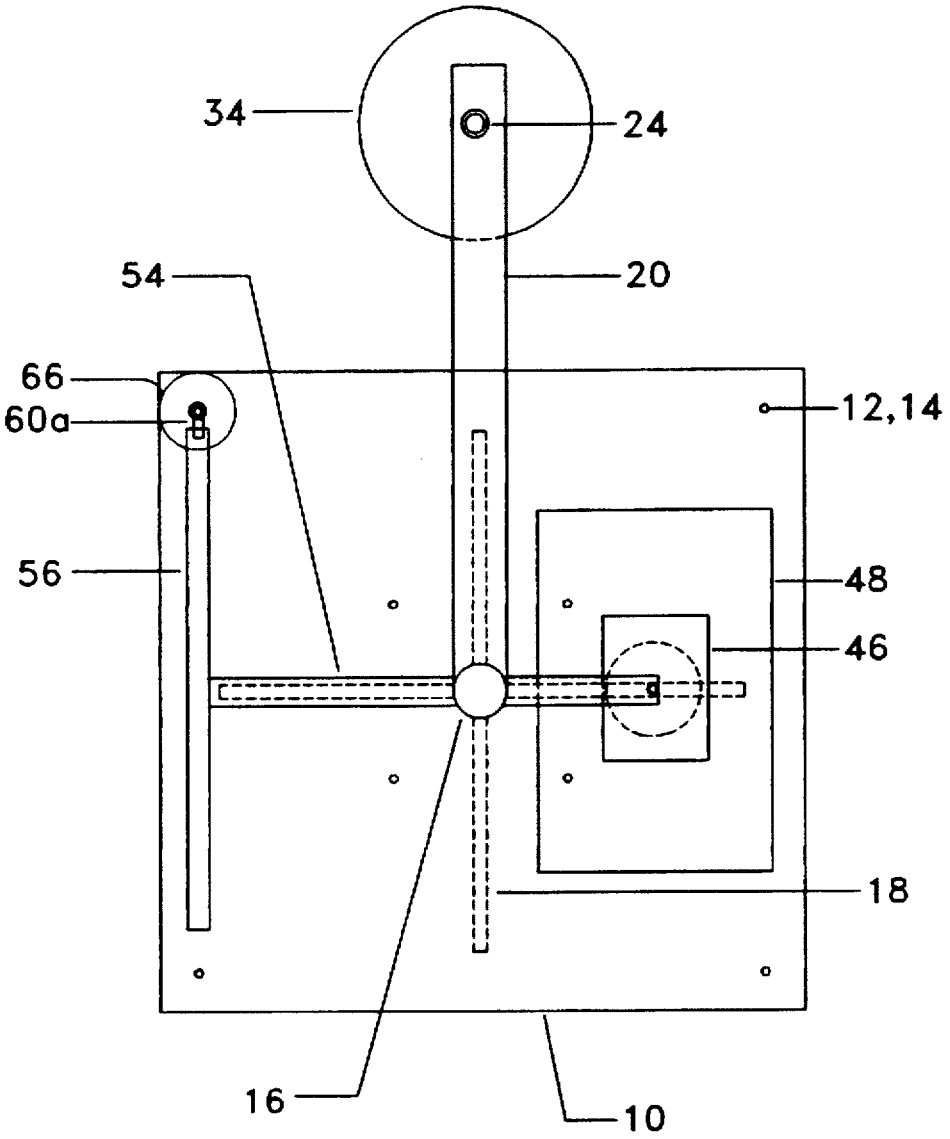
FIG. 9 a view from the top of the support stand looking down, showing the extension pole, chin up bar, hand grip bar, upper I-bolt, and back board.

FIG. 9 is a top view of the entire support stand.

This equipment is meant to be used in any home, garage, backyard, or building with a concrete floor. To set up this equipment, stand base 10 is bolted to a concrete floor, making it stationary. Then the user can hang the heavy bag 34, punching bag 66 and speed bag 52 to their respective places and start a workout. The chin up bar 54 is permanently attached to center pole 16 and ready to use. The equipment does not need to be removed when the exercise is over. Any person, male or female, can workout on this unit to train for boxing, karate, and self defense at home. This equipment offers the basic exercises for training in the above mentioned arts for professionals and amateurs alike. Bolting stand base 10 to a concrete floor gives it a solid foundation, and allows power punches to be used on heavy bag 34, speed bag 52 and punching bag 66, and makes chin up bar 54 stationary and immovable. It is the design and structure of this equipment that makes it very durable and unique.

Accordingly, the reader will see that this support stand can be installed into any home garage, cement or outdoor concrete patio area. It can be removed easily and without damage to the structure of a home.

As stated before, damage to the structure of a home has been one very important obstacle to overcome. Punching bags, heavy bags, speed bags and chin up bars have been around for many years. But the problem has always been how to install them and make use of them at home. Hanging a heavy bag from a garage ceiling is or can be very damaging to the structure of a home. Mounting a speed bag rack to a wall in a home has always caused problems due to the vibration throughout the home caused by punching the bag. This also can cause damage to the structure of a home.

Some prior art has tried to solve this problem, but the equipment has been either too big and awkward, or not stationary enough to be practical for use at home.

My support stand, however, gives a solid foundation, does not take up a lot of space, and offers a vary unique and different way of supporting and holding the equipment. This support stand also overcomes that obstacle, before mentioned, that has hindered the use of heavy bags, speed bags, punching bags and chin up bars at home. This invention is safe, does not damage the home and can be used by one or more users.

The before mentioned problem, of using this equipment at home, has been solved with my invention. Now people can train in the privacy of their home without fear of damage to their home.

We claim:

1. A three bag workout apparatus for use by a person inside a structure having a rigid floor, a ceiling and walls comprising a planar base member adapted to rest on the rigid floor of the structure, a central upstanding member having top and bottom portions and four circumferentially spaced-apart adjacent sides, means for rigidly attaching the bottom portion of the upstanding member to the base member, a punching bag, a heavy bag and a speed bag, means carried by the upstanding member adapted for supporting the punching bag, the heavy bag and the speed bag from the upstanding member in circumferentially spaced-apart positions about three of the adjacent sides of the upstanding member and means for rigidly mounting the base member to the rigid floor within the structure so that the apparatus extends upwardly from the rigid floor free of the walls and the ceiling, the support means including a bar extending horizontally from the upstanding member for use in performing chin-ups and an additional bar extending horizontally from the first named bar for use as a hand grip, the support means further including flexible means carried by the additional bar and the base member for supporting the punching bag between the additional bar and the base member, the fourth side of the upstanding member being free of workout equipment so as to permit the apparatus to be placed adjacent a wall within the structure whereby the apparatus permits a three bag workout by the person in a relatively small area within the structure without damage to the walls and the ceiling of the structure.

2. An apparatus as in claim 1 wherein the support means is configured to circumferentially position the heavy bag between the punching bag and the speed bag to permit the person to work out around the punching bag free of the walls.

3. An apparatus as in claim 1 wherein the upstanding member consists of a single pole.

4. An apparatus as in claim 1 wherein the support means includes a horizontally disposed back board, means for mounting the speed bag in a position depending from the back board and means coupled to the back board and mounted on the upstanding member for adjustment vertically of the upstanding member whereby the height of the speed bag above the rigid floor can be adjusted.

5. An apparatus as in claim 4 wherein the means mounted on the upstanding member includes a crank assembly.

6. An apparatus as in claim 1 for use with a heavy bag weighing in excess of 150 pounds wherein the base member, the upstanding member and the support means are included within means for supporting a heavy bag weighing in excess of 150 pounds free of the walls and the ceiling.

7. An apparatus as in claim 1 wherein the support means includes a crank assembly for adjusting at least the speed bag vertically of the upstanding member.

* * * * *